US006126068A

United States Patent [19]

Faircloth et al.

[11] Patent Number: 6,126,068

[45] Date of Patent: Oct. 3, 2000

[54] GARMENT DISPLAY PACKAGE

[75] Inventors: Michael Faircloth, Winston-Salem; Reid London, Clemmons, both of N.C.

[73] Assignee: Sara Lee Corporation, Winston-Salem, N.C.

[21] Appl. No.: 09/377,509

[22] Filed: Aug. 19, 1999

[51] Int. Cl.[7] ..... B65D 5/62; B65D 85/18

[52] U.S. Cl. ..... 229/162; 206/299; 206/770; 229/169

[58] Field of Search ..... 229/117.07, 117.08, 229/162, 164.1, 169; 206/299, 770, 775, 776, 777, 778, 782, 783

[56] References Cited

U.S. PATENT DOCUMENTS

| | | | |
|---|---|---|---|
| 2,547,628 | 4/1951 | Ellsworth | 229/117.07 |
| 2,652,335 | 9/1953 | Conti | 229/169 |
| 2,734,677 | 2/1956 | Arneson | 229/117.07 |
| 2,784,900 | 3/1957 | Bauer | 229/169 |
| 3,066,792 | 12/1962 | Spilman et al. | 229/162 |
| 3,168,952 | 2/1965 | Palmer | 229/162 |
| 3,178,017 | 4/1965 | Bowman | 229/164.1 |
| 3,744,706 | 7/1973 | Colantoni et al. | 229/162 |
| 4,741,435 | 5/1988 | Clarke | 229/162 |

*Primary Examiner*—Gary E. Elkins
*Attorney, Agent, or Firm*—Charles Y. Lackey; Kilpatrick Stockton LLP

[57] ABSTRACT

A garment display package having a floor, sides and ends connected to the floor with edge covering and corner closing members securing the sides and end in a fixed relationship. A transparent band encircles the package to close the package and enable visual inspection of the packaged product.

8 Claims, 1 Drawing Sheet

GARMENT DISPLAY PACKAGE

BACKGROUND OF THE INVENTION

1. Field of the Invention

The present invention relates to a garment display package and, more particularly, to a rectangular display package utilizing a transparent band to form the top of the package and allow visual inspection of the contents of the package.

2. Description of the Prior Art

Apparel packaging, particularly the packaging of hosiery products, has traditionally been in the form of boxes or flat hosiery packages enclosed in cellophane or a suitable plastic material. Such packages are usually placed in specially designed counters or free-standing displays and usually contain a single garment.

Multiple hosiery garment packages have traditionally been rectangular boxes with a bottom portion and a lid portion, the box being of sufficient height to enable the placement of from three to six hosiery garments therein. While these are very effective packages, they are expensive because of the thickness of the material used and because of the duplication of the bottom of the box in the form of the lid. These packages do offer security for the fragile products carried therein since the cardboard walls are of substantial thickness to prevent damage to the goods when the consumer handles the package.

Forming multi-unit hosiery product packages without the use of cardboard by substantially encompassing them with cellophane or a shrink-wrap material does not provide the aesthetic appearance or the stability to attract consumers.

There is a perceived need to furnish a lower priced substantially constructed multi-product hosiery package that can effectively replace the commonly used rectangular package with respect to size and counter placement. It is also desirable to provide some means in such a package to enable the consumer to view the garments contained therein without the need of lifting the lid and handling the individual packages. It is to this perceived need that the present invention is directed.

OBJECTIVES AND SUMMARY OF THE INVENTION

A primary objective of the present invention is to provide a display package of sufficient size to hold three to six units of apparel such as ladies hosiery and designed to permit visual inspection without invading the package.

Another objective of the present invention is to provide a package of the type described which is less expensive than conventional lid/bottom combination packages which must be opened to enable visual inspection of its contents.

Still another objective of the present invention is to provide a display package of the type described which is formed of a single die-cut component foldable to reach a rectangular configuration and closeable by a transparent band encircling the folded package and its contents.

It is still a further objective of the present invention is to provide a package of the type described which is similar in size to conventional packages that can be substituted for such packaging in conventional fixtures in department stores and other outlets.

The display package of the present invention includes a one piece die-cut material foldable to form a floor, two upstanding sides connected to the floor, two upstanding ends connected to the floor with each end having an edge covering member and two corner closing members. The corner closing members of each end engage a side and each edge covering member extends inwardly over and substantially parallel to the floor. A transparent band encircles the package to close the package and enable visual inspection of the packaged product.

It has been outlined in summary form the more important features of the invention in order that the detailed description that follows may be better understood and in order that the present contribution to the art may be better appreciated. There are obviously additionally features of the invention that will be described hereinafter which will form the subject matter of the claims appended hereto. It is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing structures, methods and systems for carrying out the several purposes of the present invention. It is also to be understood that the abstract is neither intended to define the invention of the application, which is measured by its claims, nor to limit its scope in any way.

This summary and these objectives of the invention, along with the various features of novelty which characterize the invention, are pointed out with particularity in the claims annexed to and forming a part of this disclosure. For a better understanding of the invention, its operating advantages, and the specific objects obtained by its use, reference should be made to the accompanying drawings and descriptive matter in which like characters of reference designate like parts throughout the several views.

DETAILED DESCRIPTION OF THE PREFERRED EMBODIMENT

Figure 1:
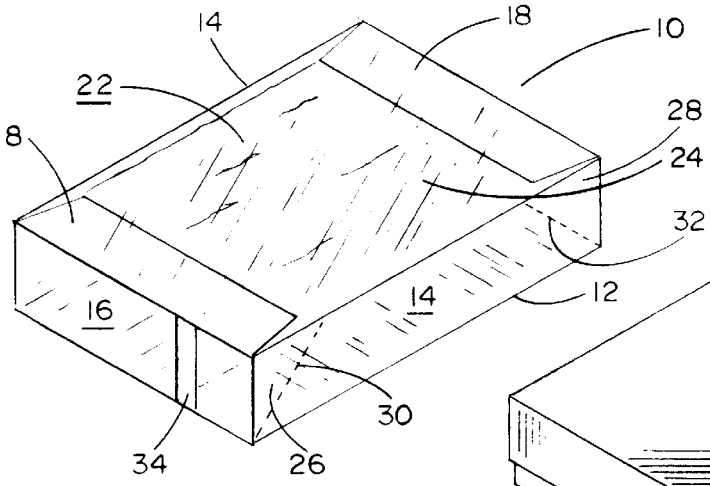
FIG. 1 is a perspective view of the package comprising the present invention showing the package containing products with the transparent band in place to visually display them.
Figure 2:
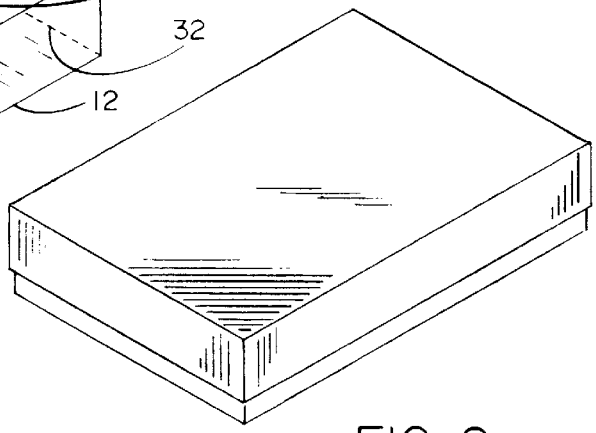
FIG. 2 is a perspective view of a prior art conventional package utilizing a bottom shell and a top shell telescopically retaining the housed products therein.

Referring now to the drawings and particularly to FIG. 1, a garment display package shown generally as 10 is formed with a floor 12, two upstanding sides 14 connected to floor 12, and two upstanding ends 16 foldably connected to floor 12. Each end 16 has an edge covering member 18 and two corner closing members 20 which engage a side 14. Each covering member 18 extends inwardly over and substantially parallel to floor 12. A transparent band 22 encircles package 10 to close package 10 and enable visual inspection of the packaged product 24.

The sides 14 each have a first end 26 and a second end 28 embossed with a diagonal crease 30 enabling each side 14 to bend inwardly along creases 30, 32 to engage the packaged product 24 when band 22 is urged there against. The band is applied with sufficient force to urge sides 14 slightly inwardly against the packaged product 24.

A window 34 is positioned in one end 16 as best shown in FIG. 1 to enable the potential purchaser to view the products contained within the package and determine a consistency of color and a precise quantity.

Figure 3:
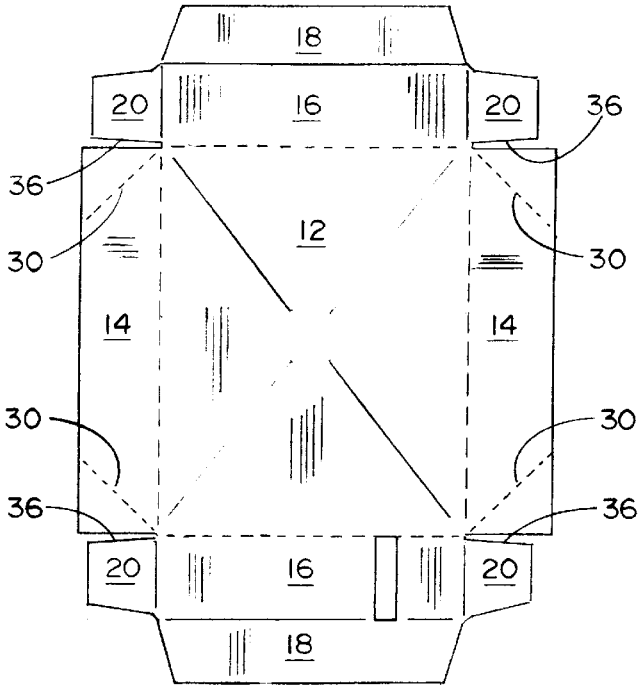
FIG. 3 is a top plan view of the one piece component forming the entire shell of the present invention, as shown assembled in FIG. 1.
Figure 4:
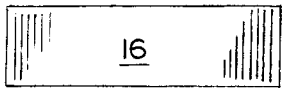
FIG. 4 is an end elevational view of the package shown in FIG. 1.
Figure 5:
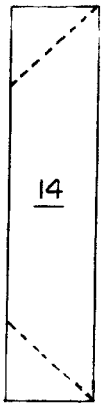
FIG. 5 is a side elevational view of the package shown in FIGS. 1 and 4.

The one piece die-cut material foldable to form the floor, sides, ends, edge covering members and corner closing members is shown in FIG. 3. The slanted edges 36 of each corner closing member 20 are deliberately designed to accommodate the slight bend inwardly of sides 14 under pressure from transparent band 22 and engage the package product in response thereto.

The previous description presents the best mode contemplated in carrying out the present invention as depicted by the preferred embodiments disclosed. The combination of features illustrated by this embodiment provides its convenience of use and ease of manufacture. The invention is, however, susceptible to modifications and alternate constructions from the embodiment shown in the drawing and described above. Consequently, it is not intended to be limited to the particular embodiment disclosed. To the contrary, the invention is to cover modifications and alternate constructions found within the scope of the invention as generally expressed by the following claims.

What is claimed is:

1. A garment display package comprising: a floor, two upstanding sides foldably connected to the floor; two upstanding ends foldably connected to the floor, each end having an edge covering member and two corner closing members, each of the corner closing members of each end having slanted lower edges and engaging one of the two sides, each edge covering member extending inwardly over and substantially parallel to the floor; and a transparent band encircling the package to close the package and enable visual inspection of the packaged product.

2. The package as claimed in claim 1 wherein each side has a first end and a second end, each of the first and second ends of each side having a diagonal crease enabling each side to bend inwardly at the creases to engage the packaged product when the band is urged there against.

3. The package as claimed in claim 1 wherein the band is secured about the package with sufficient force to urge the sides slightly inwardly against the packaged product.

4. The package as claimed in claim 2 wherein the band is secured about the package with sufficient force to urge the sides slightly inwardly against the packaged product.

5. The package as claimed in claim 1 wherein at least one of the ends has a window for viewing the products contained within the package.

6. The package as claimed in claim 2 wherein at least one of the ends has a window for viewing the products contained within the package.

7. The package as claimed in claim 3 wherein at least one of the ends has a window for viewing the products contained within the package.

8. The package as claimed in claim 4 wherein at least one of the ends has a window for viewing the products contained within the package.

* * * * *

UNITED STATES PATENT AND TRADEMARK OFFICE
Certificate

Patent No. 6,126,068 Patented: October 3, 2000

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Michael Faricloth, Winston-Salem, NC; Reid London, Clemmons, NC; James L. Jones, Yadkinville, NC.

Signed and Sealed this Thirteenth Day of March, 2001.

ALLAN N. SHOAP
*Supervisory Patent Examiner*
Art Unit 3727